US005127334A

United States Patent [19]

Theurer

[11] Patent Number: 5,127,334

[45] Date of Patent: Jul. 7, 1992

[54] BALLAST TAMPING MACHINE

[75] Inventor: Josef Theurer, Vienna, Austria

[73] Assignee: Franz Plasser Bahnbaumaschinen-Industriegesellschaft m.b.H., Vienna, Austria

[21] Appl. No.: 689,168

[22] Filed: Apr. 22, 1991

[30] Foreign Application Priority Data

May 2, 1990 [AT] Austria ..... A 1000/90

[51] Int. Cl.[5] ..... E01B 27/16

[52] U.S. Cl. ..... 104/12

[58] Field of Search ..... 104/12, 10

[56] References Cited

U.S. PATENT DOCUMENTS 4,428,297 1/1984 Ganz ..... 104/12

4,445,437 5/1984 Nielsen ..... 104/12

*Primary Examiner*—Robert J. Oberleitner

*Assistant Examiner*—Kevin D. Rutherford

*Attorney, Agent, or Firm*—Collard & Roe

[57] ABSTRACT

A mobile ballast tamping machine comprises a tamping unit associated with, and adjacent, the field side and the gage side of each track rail, the field side and gage side tamping units associated with each rail being adjacent each other in a direction extending transversely to the track and each tamping unit comprising a pair of vibratory tamping tools reciprocable in a direction extending substantially parallel to the track, a vertically adjustable tamping tool carrier supporting the pair of tamping tools, a support frame, vertical guides connected to the support frame and vertically adjustably supporting the tamping tool carrier, the support frame of each field side tamping unit being supported on the support frame of the adjacent gage side tamping unit. A displacement drive is connected to each field side tamping unit support frame for adjustably spacing the field side tamping unit support frame from the adjacent gage side tamping unit in the transverse direction, and a guide extends in the transverse direction and supports the gage side tamping units for independent displacement in the transverse direction.

6 Claims, 1 Drawing Sheet

Fig.1
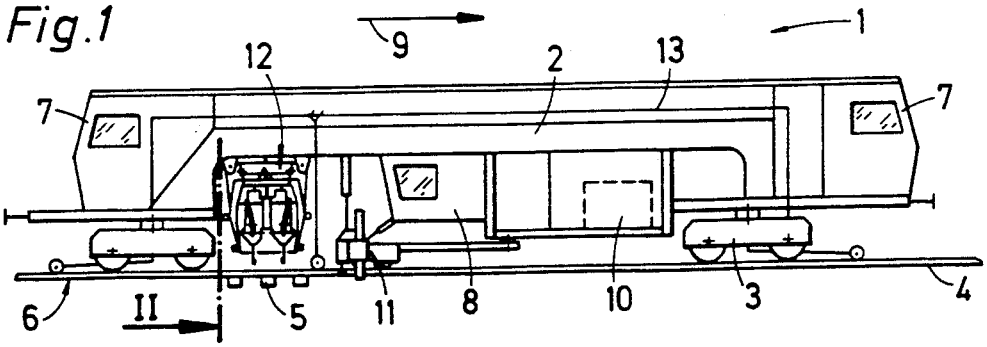
Fig.2
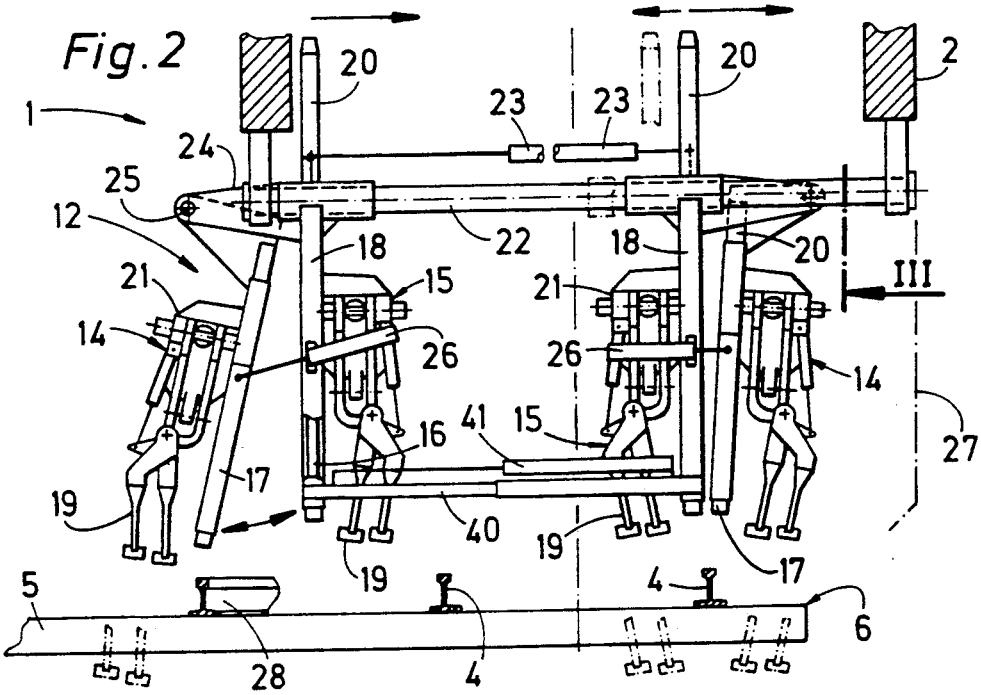
Fig.3
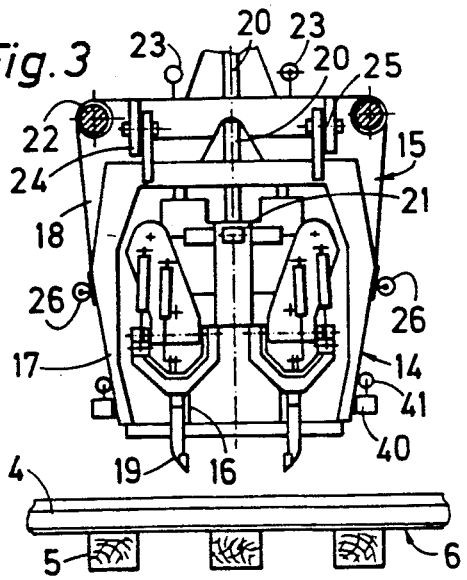
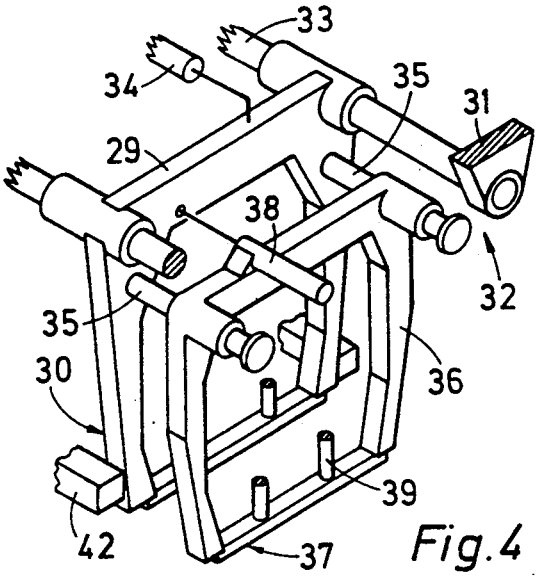
Fig.4

BALLAST TAMPING MACHINE

BACKGROUND OF THE INVENTION

1. Field of the Invention

The present invention relates to a mobile ballast tamping machine movable in an operating direction along a track comprising two rails fastened to a succession of ties, each rail having a field side and a gage side, the machine comprising a tamping unit associated with, and adjacent, each side of the rails, the field side and gage side tamping units associated with each rail being adjacent each other in a direction extending transversely to the track and being adjustable in a direction extending transversely to the track, and each tamping unit comprising a pair of vibratory tamping tools reciprocable in a direction extending substantially parallel to the track, a vertically adjustable tamping tool carrier supporting the tamping tools, a support frame, and vertical guide means connected to the support frame and vertically adjustable supporting the tamping tool carrier.

2. Description of the Prior Art

U.S. Pat. No. 4,445,437, dated May 1, 1984 discloses a mobile ballast tamping machine of this general type and having four tamping units respectively arranged at the gage and field sides of the two track rails. Each tamping unit is independently adjustable by its own drive in a direction extending transversely to the track. Each tamping unit has conventional pairs of reciprocable tamping tools supported on a tamping tool carrier which is vertically adjustably mounted on a frame for immersion of the tamping tools in the ballast. The transverse adjustability of the tamping units is accomplished by a mechanism connecting each tamping tool carrier to the machine frame by means of a transverse guide and coupling links. When the transverse adjustment drive for a tamping unit is actuated, a compound motion is imparted to the unit so that the unit is not only horizontally displaced but its tamping tool carrier is also pivoted. During this compound motion, the lower end of the tamping tool carrier, which supports the tamping tools, traverses an arcuate displacement path which is longer than the displacement path of its upper end, to which the coupling links are connected and which is displaced rectilinearly along the transverse guide. This machine enables long ties in track switches to be tamped but the structure is relatively complex and accordingly prone to malfunctions and breakdowns.

U.S. Pat. No. 4,576,095, dated Mar. 18, 1986, discloses a ballast tamping machine with two tamping heads respectively associated with each track rail, the tamping heads being independently transversely displaceable along a transverse guide on the machine frame. Each tamping head comprises a frame and vertical guides on the frame support two tamping tool carriers with conventional pairs of tamping tools for independent vertical adjustment so that the tamping tools may be immersed independently of each other at the field and gage sides of the rails. This makes it possible to operate only one of the pairs of tamping tools at each rail if the other pair encountered an obstacle when lowered. The transverse guide for the tamping heads permits them to be transversely displaced only within the approximate width of the track.

In the tamping machine disclosed in U.S. Pat. No. 4,094,251, dated Jun. 13, 1978, a respective vertically adjustable tamping head is associated with each rail and each tamping head carries two pairs of tamping tools respectively arranged on the field and gage side of the associated rail. A transverse displacement drive links the field side pair of tamping tools to the gage side pair of tamping tools for adjustably spacing the field side tools from the gage side tools for operation in track switches.

U.S. Pat. No. 4,899,664, dated Feb. 13, 1990, discloses a tamping head with four tamping units arranged at the field and gage sides of the two track rails and displaceable independently from each other along a transverse guide means.

SUMMARY OF THE INVENTION

It is the primary object of this invention to provide a switch tamper incorporating a relatively simple structure enabling the pairs of tamping tools at each side of each rail to be transversely displaced through a substantial displacement path.

In a mobile ballast tamping machine which is movable in an operating direction along a track comprising two rails fastened to a succession of ties, each rail having a field side and a gage side, and which comprises a tamping unit associated with, and adjacent, each side of the rails, the field side and gage side tamping units associated with each rail being adjacent each other in a direction extending transversely to the track and each tamping unit comprising a pair of vibratory tamping tools reciprocable in a direction extending substantially parallel to the track, a vertically adjustable tamping tool carrier supporting the pair of tamping tools, a support frame, and vertical guide means connected to the support frame and vertically adjustably supporting the tamping tool carrier, the above and other objects are accomplished according to this invention by supporting the support frame of each field side tamping unit on the support frame of the adjacent gage side tamping unit, connecting a displacement drive to each field side support frame for adjustably spacing the field side support frame from the adjacent gage side tamping unit in the transverse direction, and supporting the gage side tamping unit support frames on a guide means extending in the transverse direction for independent displacement in the transverse direction.

Since the field side tamping units are adjustably connected to the adjacent gage side tamping units, the latter may be transversely displaced along the transverse guide means to a maximum extent towards the field sides and this maximum transverse displacement may be further extended by a further displacement of the field side tamping units. It is thus possible with a relatively simple structure to adapt the tamping machine either for use along tangent track by simply coupling the two adjacent tamping units together at a constant spacing or for use along an irregular rail path, i.e. at switches or at crossings, when the transverse displacement drive is operated to change the spacing between the adjacent tamping units.

According to one embodiment of the invention, each field side tamping unit support frame is mounted on the gage side tamping unit support frame for pivoting about an axis extending substantially parallel to the track and above the field side tamping unit. This provides a simple and robust support structure well adapted to absorbing the considerable impact forces generated during a tamping operation. If such a structure comprises respective overlapping bracket connectors projecting from the field and gage side tamping unit support frames in the transverse direction and the pivoting axis passes through the overlapping bracket connectors at a distance from the support frames, even a substantial pivoting angle will cause the distance of the tamping pick from the surface of the ballast to be changed only a little so that the immersion depth will not be appreciably varied even in case of a considerable transverse displacement.

According to the preferred feature of the present invention, two of the displacement drives connect each field side tamping unit support frame to the adjacent gage side tamping unit support frame substantially intermediate the upper and lower ends thereof, the two displacement drives being spaced from each other in the direction of the track. This arrangement enables the displacement drives to be relatively short while, at the same time, assuring a secure pivoting of the field side tamping unit frame without danger of twisting.

According to another embodiment, each field side tamping unit support frame is supported on the support frame of the adjacent gage side tamping unit for sliding displacement in the transverse direction. With this arrangement, it is possible to vary the spacing between the adjacent tamping units without causing the field side tamping unit to assume an oblique position. In this way, all the tamping picks are immersed in the ballast in a vertical position extending perpendicularly to the ballast. In this embodiment, guides affixed to the support frame of the adjacent gage side tamping unit may extend in the transverse direction substantially parallel to the transverse guide means and the support frame of the field side tamping unit may be displaceably supported on the guides. In this way, the field side tamping units may be transversely displaced without disadvantageously changing the immersion depth of the tamping picks in the ballast while the displacement structure remains simple and robust.

BRIEF DESCRIPTION OF THE DRAWING

The above and other objects, advantages and features of the present invention will become more apparent from the following detailed description of certain now preferred embodiments thereof, taken in conjunction with the accompanying drawing wherein FIG. 1 is a schematic side elevational view of a tamping machine with transversely displaceable tamping units according to this invention;

FIG. 2 is an enlarged end view of the four tamping units of the invention, seen in the direction of arrow II in FIG. 1;

FIG. 3 is a side elevational view in the direction of arrow III of FIG. 2; and

FIG. 4 is a fragmentary perspective view showing another embodiment of two adjacent tamping units associated with each rail, only the support frames of the two tamping units without the tamping tool carriers and tamping tools being shown to provide a clearer understanding of the displacement structure.

DETAILED DESCRIPTION OF PREFERRED EMBODIMENTS

Referring now to the drawing and first to FIGS. 1 to 3, there is shown mobile ballast tamping machine 1 movable in an operating direction indicated by arrow 9 along track 6 comprising two rails 4 fastened to a succession of ties 5, each rail having a field side and a gage side. The machine comprises elongated machine frame 2 whose ends are supported on the track by undercarriages 3, 3. Driver's cabs 7, 7 are mounted on the machine frame at the ends thereof and operator's cab 8 is mounted on the machine frame intermediate its ends. Power plant 10 on the machine frame serves to provide power to the machine drive and all the operating drives of the machine, including the drives for track lifting and lining unit 11 and switch ballast tamping assembly 12 succeeding the track lifting and lining unit in the operating direction, the operation of the track lifting and lining unit being controlled by a leveling and lining reference system 13. Track leveling, lining and tamping machines of this type are conventional.

As will be more apparent from FIGS. 2 and 3, the ballast tamping assembly comprises a respective tamping unit associated with, and adjacent, each side of rails 4, field side tamping units 14 and gage side tamping units 15 associated with each rail 4 being adjacent each other in a direction extending transversely to track 6. Each tamping unit comprises a pair of vibratory tamping tools 19 reciprocable in a direction extending substantially parallel to the track, vertically adjustable tamping tool carrier 21 supporting the pairs of tamping tools, support frame 17, 18 and vertical guides 16 connected to support frame 17, 18 and vertically adjustably supporting the tamping tool carrier. Vertical adjustment drives 20 are connected to tamping tool carriers 21 to enable the tamping tool carriers to be lowered for immersion of the tamping tools in the ballast (see fragmentary phantom lines in FIG. 2). The vertical adjustment drives for gage side tamping units 15 are arranged above their support frames 18 while the vertical adjustment drives for tamping tool carriers 21 of field side tamping units 14 extend largely into their support frames 17, as will be seen in FIG. 3.

According to this invention, support frame 17 of each field side tamping unit 14 is supported on support frame 18 of adjacent gage side tamping unit 15, displacement drive 26 is connected to each field side support frame 17 for adjustably spacing the field side support frame from adjacent gage side tamping unit 15 in the transverse direction, and guides 22, which are affixed to machine frame 2, extend in the transverse direction and support gage side tamping unit support frames 18 for independent displacement in the transverse direction. Respective transverse displacement drives 23 are connected to support frames 18 for independently displacing them along guides 22, together with the field side tamping units whose support frames 17 are supported on support frame 18 of the gage side tamping units.

In the embodiment illustrated in FIGS. 2 and 3, each field side tamping unit support frame 17 is mounted on gage side tamping unit support frame 18 for pivoting about axis 25 extending substantially parallel to track 6 and above field side tamping unit 14. Respective overlapping bracket connectors 24, 24 project from field and gage side tamping unit support frames 17, 18 in the transverse direction and pivoting axis 25 passes through the overlapping bracket connectors at a distance from the support frames. As shown in FIG. 3, two displacement drives 26, 26 connect each field side tamping unit support frame 17 to adjacent gage side tamping unit support frame 18 substantially intermediate the upper and lower ends thereof, the two displacement drives being spaced from each other in the direction of the track. When operating normally (see right side of FIG. 2), the two tamping tool unit support frames 17, 18 associated with each rail 4 are locked together at a desired transverse spacing. Two telescoping connecting rods 40, which are spaced from each other in the direction of the track (like transverse displacement drives 26), connect gage side support frames 18 to each other at a variable transverse distance and drives 41 interconnect the two parts of the telescoping connecting rods to vary the length of the rods and thus to vary the transverse distance therebetween, at which selected distance the drives lock the adjusted rod parts in position.

To illustrate the operation of the tamping units, the right side of FIG. 2 shows tamping units 14, 15 centered over right rail 4 for tamping tie 5, in which position no part of field gage tamping unit 14, including bracket connectors 24, 24, projects beyond the track profile indicated in phantom lines at 27. After tamping units 14, 15 centered likewise over left rail 4 have also tamped tie 5 at this rail, transverse displacement drive 23 is operated to displace the two units towards the field side to center left tamping units 14, 15 over rail 28 of a branch track for tamping the tie there. To reach the gage side of rail 28 of the branch track with tamping tools 19, adjustment drives 26 are additionally operated to pivot field side tamping unit 14 and thus to distance it further from gage side tamping unit 15. In this position of the field side tamping unit, vertical adjustment drive 20 is operated to lower the tamping tools into their tamping position. After tamping unit 15 has been centered over rail 28, drives 41 are operated to lock the two tamping units together.

In this manner and by suitable operation of drives 23 and 26, all tamping sites at a long tie in a track switch can be reached, even at a relatively large distance of a branch track rail from main track 6. As is known and illustrated, tamping tools 19 may be independently pivoted in a transverse direction so that individual tamping tools may be swung out of their operative position if they would encounter track obstacles upon lowering of the tamping units. After tie 5 has been tamped at each rail of the switch, the tamping units are raised and the machine is advanced to the succeeding ties, where the operation is repeated.

In the embodiment illustrated in FIG. 4, support frame 36 of each field side tamping unit 37 is supported on support frame 29 of adjacent gage side tamping unit 30 for sliding displacement in the transverse direction. Two guides 35 extend in the transverse direction substantially parallel to transverse guides 33 connected to machine frame 31 of a ballast tamping machine 32 (not further illustrated), in the same manner as guides 22 of machine 1, and guides 35 are affixed to support frame 29 of the adjacent gage side tamping unit. Support frame 36 of field side tamping unit 37 is displaceably supported on guides 35. Functioning equivalently to adjustment drive 26 of the previously described embodiment, transverse adjustment drive 38 interconnects support frames 29 and 36 to vary the transverse spacing of the field side support frame from the gage side support frame. Vertical guides 39 are connected to the support frames for vertically adjustably supporting (non-illustrated) tamping tool carriers and their tamping tools in the same manner as described in connection with the embodiment of FIGS. 2 and 3. In substance, this embodiment functions in the same manner, differing therefrom by supporting the field side tamping unit support frame transversely slidably, instead of pivotally, on the gage side tamping unit support frame.

In a slight and equivalent modification of the last-described embodiment, the outer end of guides 35 may be stationarily affixed to field side tamping unit support frame 36 and may be slidably displaced with respect to the gage side tamping unit support frame. As in the embodiment of FIGS. 2 and 3, the two gage side tamping unit supports frames 29, 29 are interconnected by a variable-length telescoping linkage 42.

What is claimed is:

1. A mobile ballast tamping machine movable in an operating direction along a track comprising two rails fastened to a succession of ties, each rail having a field side and a gage side, the machine comprising (a) a tamping unit associated with, and adjacent, each side of the rails, the field side and gage side tamping units associated with each rail being adjacent each other in a direction extending transversely to the track and each tamping unit comprising (1) a pair of vibratory tamping tools reciprocable in a direction extending substantially parallel to the track, (2) a vertically adjustable tamping tool carrier supporting the pair of tamping tools, (3) a support frame, (4) vertical guide means connected to the support frame and vertically adjustably supporting the tamping tool carrier, (5) the support frame of each field side tamping unit being supported on the support frame of the adjacent gage side tamping unit, (b) a displacement drive connected to each field side support frame for adjustably spacing the field side support frame from the adjacent gage side tamping unit in the transverse direction, and (c) a guide means extending in the transverse direction and supporting the gage side tamping unit support frames for independent displacement in the transverse direction.

2. The mobile ballast tamping machine of claim 1, wherein each field side tamping unit support frame is mounted on the gage side tamping unit support frame for pivoting about an axis extending substantially parallel to the track and above the field side tamping unit.

3. The mobile ballast tamping machine of claim 2, further comprising respective overlapping bracket connectors projecting from the field and gage side tamping unit support frames in the transverse direction, the pivoting axis passing through the overlapping bracket connectors at a distance from the support frames.

4. The mobile ballast tamping machine of claim 1, wherein two of the displacement drives connect each field side tamping unit support frame to the adjacent gage side tamping unit support frame substantially intermediate the upper and lower ends thereof, the two displacement drives being spaced from each other in the direction of the track.

5. The mobile ballast tamping machine of claim 1, wherein each field side tamping unit support frame is supported on the support frame of the adjacent gage side tamping unit for sliding displacement in the transverse direction.

6. The mobile ballast tamping machine of claim 5, further comprising guides extending in the transverse direction substantially parallel to the transverse guide means and affixed to the support frame of the adjacent gage side tamping unit, the support frame of the field side tamping unit being displaceably supported on the guides.

* * * * *